US009306273B2

(12) United States Patent
Leisten

(10) Patent No.: US 9,306,273 B2
(45) Date of Patent: Apr. 5, 2016

(54) MULTIFILAR ANTENNA

(71) Applicant: Harris Corporation, Melbourne, FL (US)

(72) Inventor: Oliver Paul Leisten, Raunds (GB)

(73) Assignee: Harris Corporation, Melbourne, FL (US)

( * ) Notice: Subject to any disclaimer, the term of this patent is extended or adjusted under 35 U.S.C. 154(b) by 205 days.

(21) Appl. No.: 14/096,786

(22) Filed: Dec. 4, 2013

(65) Prior Publication Data

US 2014/0159983 A1 Jun. 12, 2014

(30) Foreign Application Priority Data

Dec. 6, 2012 (GB) ..... 1221996.0

(51) Int. Cl.
*H01Q 1/36* (2006.01)
*H01Q 11/08* (2006.01)
*H01Q 5/371* (2015.01)

(52) U.S. Cl.
CPC ..... *H01Q 1/362* (2013.01); *H01Q 5/371* (2015.01); *H01Q 11/08* (2013.01)

(58) Field of Classification Search
USPC ..... 343/859, 895
See application file for complete search history.

(56) References Cited

U.S. PATENT DOCUMENTS 5,134,422 A * 7/1992 Auriol ..... H01Q 11/08 343/895
5,300,940 A 4/1994 Simmons
5,541,616 A 7/1996 Kawahata et al.
5,828,348 A * 10/1998 Tassoudji ..... H01Q 11/08 343/853
5,854,608 A * 12/1998 Leisten ..... H01Q 1/242 343/821
5,859,621 A * 1/1999 Leisten ..... H01Q 11/08 343/821
5,986,616 A * 11/1999 Edvardsson ..... H01Q 1/242 333/116
6,184,845 B1 * 2/2001 Leisten ..... H01Q 1/242 343/821
7,002,530 B1 * 2/2006 Chung ..... H01Q 1/244 333/26

(Continued)

FOREIGN PATENT DOCUMENTS

CN 2899134 5/2007
DE 102004040258 2/2006

(Continued)

OTHER PUBLICATIONS

Search Report dated Mar. 22, 2013, from corresponding GB Patent Application No. 1221996.0, 5 pp.

(Continued)

*Primary Examiner* — Tan Ho
(74) *Attorney, Agent, or Firm* — Klarquist Sparkman, LLP

(57) ABSTRACT

Disclosed herein are example embodiments of a dielectrically loaded multifilar antenna for circularly polarised radiation the antenna having a plurality of operating frequencies in excess of 200 MHz. In one embodiment, the antenna comprises: an electrically insulative core having proximal and distal surface portions and, between the proximal and distal surface portions, a laterally directed side surface portion; a pair of feed nodes; at least four elongate generally helical conductive radiating elements located on the core; and, arranged between and coupling together the feed nodes and the radiating elements, a phasing ring formed by a closed loop, wherein the phasing ring is resonant at least two of the operating frequencies, the elongate antenna elements being coupled to the phasing ring at respective spaced apart coupling locations and extending from the phasing ring in a direction away from the feed nodes.

29 Claims, 4 Drawing Sheets

(56) References Cited

U.S. PATENT DOCUMENTS

| | | | | |
|---|---|---|---|---|
| 8,514,144 | B2 | 8/2013 | Gray et al. | |
| 9,112,273 | B2 | 8/2015 | Christie et al. | |
| 2003/0048235 | A1 | 3/2003 | Fukae et al. | |
| 2004/0252063 | A1 | 12/2004 | Sadamori et al. | |
| 2005/0200554 | A1 | 9/2005 | Chau | |
| 2006/0022891 | A1 | 2/2006 | O'Neill et al. | |
| 2006/0022892 | A1 | 2/2006 | O'Neill et al. | |
| 2006/0103586 | A1* | 5/2006 | Yang | H01Q 1/362 343/895 |
| 2006/0202902 | A1 | 9/2006 | Noro et al. | |
| 2008/0062060 | A1 | 3/2008 | Noro et al. | |
| 2008/0074328 | A1 | 3/2008 | Noro et al. | |
| 2008/0174501 | A1 | 7/2008 | Licul et al. | |
| 2008/0316138 | A1* | 12/2008 | Tavassoli Hozouri | H01Q 1/36 343/859 |
| 2009/0081963 | A1 | 3/2009 | Boren | |
| 2011/0025580 | A1 | 2/2011 | Gray et al. | |
| 2011/0215986 | A1 | 9/2011 | Tongue | |
| 2011/0221650 | A1 | 9/2011 | Christie et al. | |
| 2012/0287016 | A1 | 11/2012 | Zalinska et al. | |
| 2013/0099999 | A1 | 4/2013 | Christie | |
| 2013/0135169 | A1 | 5/2013 | Christie | |
| 2013/0181881 | A1 | 7/2013 | Christie et al. | |

FOREIGN PATENT DOCUMENTS

| | | |
|---|---|---|
| DE | 102011009283 | 7/2012 |
| EP | 1643594 | 4/2006 |
| GB | 2444388 | 6/2008 |
| GB | 2445478 | 7/2008 |
| GB | 2468582 | 9/2010 |
| GB | 2468583 | 9/2010 |
| GB | 2471578 | 1/2011 |
| GB | 2473676 | 3/2011 |
| GB | 2477289 | 8/2011 |
| GB | 2477290 | 8/2011 |
| GB | 2482411 | 2/2012 |
| JP | 04-271188 | 9/1992 |
| JP | 07-202538 | 8/1995 |
| JP | 07-312520 | 11/1995 |
| JP | 10-256818 | 9/1998 |
| JP | 2001-267826 | 9/2001 |
| JP | 2002-217621 | 8/2002 |
| JP | 2010-200050 | 9/2010 |
| KR | 10-2007-0079761 | 8/2007 |
| WO | WO 99/34481 | 7/1999 |
| WO | WO 99/60663 | 11/1999 |
| WO | WO 03/044895 | 5/2003 |
| WO | WO 2008/001169 | 1/2008 |
| WO | WO 2008/032886 | 3/2008 |
| WO | WO 2008/088099 | 7/2008 |
| WO | WO 2008/144240 | 7/2008 |
| WO | WO 2012/100859 | 8/2012 |
| WO | WO 2013/057478 | 4/2013 |

OTHER PUBLICATIONS

International Search Report and Written Opinion dated Feb. 26, 2014, from International Patent Application No. PCT/IB2013/060603, 10 pp.

* cited by examiner

MULTIFILAR ANTENNA

CROSS-REFERENCE TO RELATED APPLICATIONS

This application claims priority to United Kingdom Patent Application No. 1221996.0, filed on Dec. 6, 2012, and entitled, "A MULTIFILAR ANTENNA," which is hereby incorporated herein by reference.

FIELD

This disclosure relates to a multifilar antenna for circularly polarised radiation having a plurality of operating frequencies in excess of 200 MHz, and primarily but not exclusively to dielectrically loaded multifilar antennas.

BACKGROUND

Dielectrically-loaded multifilar antennas are disclosed in Published International Patent Application No. WO 2006/136809, British Patent Publication No. 2442998A, European Patent Publication No. EP1147571A, British Patent Publications Nos. 2420230A, 2444388A, 2437998A and 2445478A. The entire disclosure of these patent publications is incorporated in the present application by reference. Such antennas are intended mainly for receiving circularly polarised signals from a Global Navigation Satellite System (GNSS), e.g. from satellites of the Global Positioning System (GPS) satellite constellation, for position fixing and navigation purposes. Other satellite-based services for which such antennas are useful include satellite telephone services such as the L-band Inmarsat service 1626.5-1675.0 MHz and 1518.0-1559.0 MHz, the TerreStar S-band service, the ICO Global Communications S-band service and the SkyTerra service. The S-band services have allocated frequency bands in the range of from 2000 MHz to 2200 MHz. The reader would appreciate that TerreStar and ICO are both owned by Dish Network, and SkyTerra was acquired by Harbinger Capital Partners and became part of LightSquared in 2010.

Each of these antennas has a plurality of helical antenna elements which are plated on a substantially cylindrical electrically insulative core made of a high relative dielectric constant material such as barium titanate. The material of the core occupies the major part of the volume defined by the core outer surface. Extending through the core from one end face to an opposite end face is an axial bore or passage containing a feed. At one end of the bore conductors of the feed are coupled to respective antenna elements which have associated connection conductors plated on the respective end face adjacent the end of the passage. At the other end of the passage, one of the feed conductors is connected to a conductor which links the antenna elements and, in each of these examples, is in the form of a conductive sleeve encircling part of the core to form a balun. Each of the antenna elements terminates on a rim of the sleeve and each follows a respective helical path from its connection to the feed.

The conductive sleeve referred to above is coupled to the outer shield of the feed structure where it emerges at a proximal end face of the antenna to form a balun at the frequencies of certain modes of resonance of the antenna. This effect occurs when the electrical length of the sleeve and its connection to the feed structure (with respect to currents on the inner surface of the sleeve) is (2n−1)② g/4 where )② g is the guide wavelength of the relevant resonance, and n is a positive integer. The operation of the conductive sleeve rim as a resonant element is described in more detail in the above-mentioned EP1147571A.

SUMMARY

According to a first aspect of the disclosed technology, there is provided a dielectrically loaded multifilar antenna for circularly polarised radiation, the antenna having a plurality of operating frequencies in excess of 200 MHz, wherein the antenna comprises: an electrically insulative core having proximal and distal surface portions; and, between the proximal and distal surface portions, a laterally directed side surface portion; a pair of feed nodes; at least four elongate generally helical conductive radiating elements located on the core, and, arranged between and coupling together the feed nodes and the radiating elements, a phasing ring formed by a closed loop, the radiating elements being coupled to the phasing ring at respective spaced apart coupling locations; the antenna further comprising a conductive linking element extending around the core side surface portion, wherein the radiating elements comprise a first group of elements extending from the phasing ring over the core side surface portion to closed-circuit terminations on the linking element and a second group of elements extending from the phasing ring to open-circuit terminations on the said side surface portion which are spaced from the linking element, and wherein each of the elements of one of said groups is meandered about a respective pure helix.

Feeding the radiation elements via the phasing ring provides the effect of feeding the radiating elements in a phase progression, yielding a circular polarisation characteristic.

The radiating elements may comprise conductive tracks metallised on the core side surface portion, the tracks of the said one group of elements having a centreline which deviates from a respective pure helix to form a generally sinusoidal path.

The sinusoidal path may have a peak-to-peak amplitude of less than or equal to 3 mm.

Preferably, the said one group is the second group of radiating elements.

The electrical length of each of the radiating elements in the second group may be different from the electrical length of each of the radiating elements in the first group.

The electrical length of each of the radiating elements in the first group may be a half wavelength or an integer multiple thereof at a first of the operating frequencies.

The electrical length of each of the radiating elements in the second group may be a (2n−1)/4 times the wavelength at a second of the operating frequencies, where n is a positive integer.

Preferably, the antenna has at least ten helical antenna elements.

Preferably, the antenna has a central axis and the phasing ring comprises a conductive track encircling the central axis of the antenna.

The conductive track have an inner edge and an outer edge, and preferably the phasing ring further comprises one or more inwardly extending radial sections extending from said inner edge of said conductive track.

Preferably, each radiating element executes a turn about the axis at a pitch angle.

Each radiating element in the first group may execute a turn at a first pitch angle that is greater than said pitch angle, and each radiating element in the second group may execute a turn at a second pitch angle that is lower than said pitch angle.

Preferably, the phasing ring is resonant at at least one of the operating frequencies.

The phasing ring may comprise a conductive track located on the distal surface portion and encircling the central axis of the antenna.

The conductive track of the phasing ring may be formed such that the phasing ring resonates at one or more frequencies determined by the physical path length and the relative dielectric constant of the core material.

Preferably, the phasing ring is circular, although other configurations are possible, including a square or other polygon. Alternatively, the phasing ring may be a meandered circle (i.e. following a path which deviates in a repetitive way to the inside and outside of a circle). The meandering of the phasing ring may have a sinusoidal peak-to-peak centreline amplitude that is less than or equal to 2 mm.

The phasing ring may comprise a continuous annular conductor.

The phasing ring may include at least a pair of lumped reactances in series with conductive track portions, which portions, together with the reactances, form the said closed loop which is resonant at said one or more operating frequencies.

Preferably, the antenna is constructed as a backfire antenna.

Alternatively, the antenna is constructed as an end-fire antenna.

In a second aspect of the disclosed technology there is provided a dielectrically loaded multifilar antenna for circularly polarised radiation, the antenna having a plurality of operating frequencies in excess of 200 MHz, wherein the antenna comprises: an electrically insulative core having proximal and distal surface portions and, between the proximal and distal surface portions, a laterally directed side surface portion; a pair of feed nodes; at least four elongate generally helical conductive radiating elements located on the core; and, arranged between and coupling together the feed nodes and the radiating elements, a phasing ring formed by a closed loop, wherein the phasing ring is resonant at at least two of the operating frequencies, the elongate antenna elements being coupled to the phasing ring at respective spaced apart coupling locations and extending from the phasing ring in a direction away from the feed nodes.

The phasing ring may comprise a continuous annular conductor.

Preferably, the antenna has a central axis, and the phasing ring comprises a conductive track encircling the axis.

Preferably, the conductive track has an inner edge and an outer edge, and the phasing ring further comprises one or more inwardly extending radial sections extending from the inner edge of said conductive track.

The conductive track of the phasing ring may be meandered.

The meandering of the phasing ring may have a sinusoidal peak-to-peak centreline amplitude that is less than or equal to 2 mm.

The feed nodes and the phasing ring may be located on the distal surface portion, and the said elongate conductive radiating elements extend over the side surface portion from the phasing ring towards the proximal surface portion.

Preferably, the antenna further comprises a conductive linking element extending around the core side surface portion, wherein the radiating elements comprise a first group of elements extending from the phasing ring over the core side surface portion to closed-circuit terminations on the linking element and a second group of elements extending from the phasing ring to open-circuit terminations on the said side surface portion which are spaced from the linking element, and wherein each of the elements of one of said groups is meandered about a respective pure helix.

Preferably, the radiating elements comprise conductive tracks metallised on the core side surface portion, the tracks of the said one group of elements having a centreline which deviates from a respective pure helix to form a generally sinusoidal path of which the peak-to-peak amplitude is less than or equal to 3 mm.

In this specification, the term "radiating", when applied to elements of the antenna, refers to elements which radiate an electromagnetic field should the antenna be energised from a transmitter operating at the operating frequency of the antenna. It will be understood that when the antenna is coupled, instead, to a receiver, such elements absorb electromagnetic energy from the surroundings and the antenna then acts in a reciprocal way. It follows that statements and claims herein containing the term "radiating" embrace within their scope an antenna intended solely for use with a receiver as well as antennas used for transmitting.

DESCRIPTION OF THE DRAWINGS

Embodiments of the disclosed technology will now be described with reference to the accompanying drawings, in which.

DETAILED DESCRIPTION

Specific embodiments will be described in further detail in the following paragraphs on the basis of the attached figures. It will be appreciated that this is by way of example only, and should not be viewed as presenting any limitation on the scope of protection.

Figure 1:
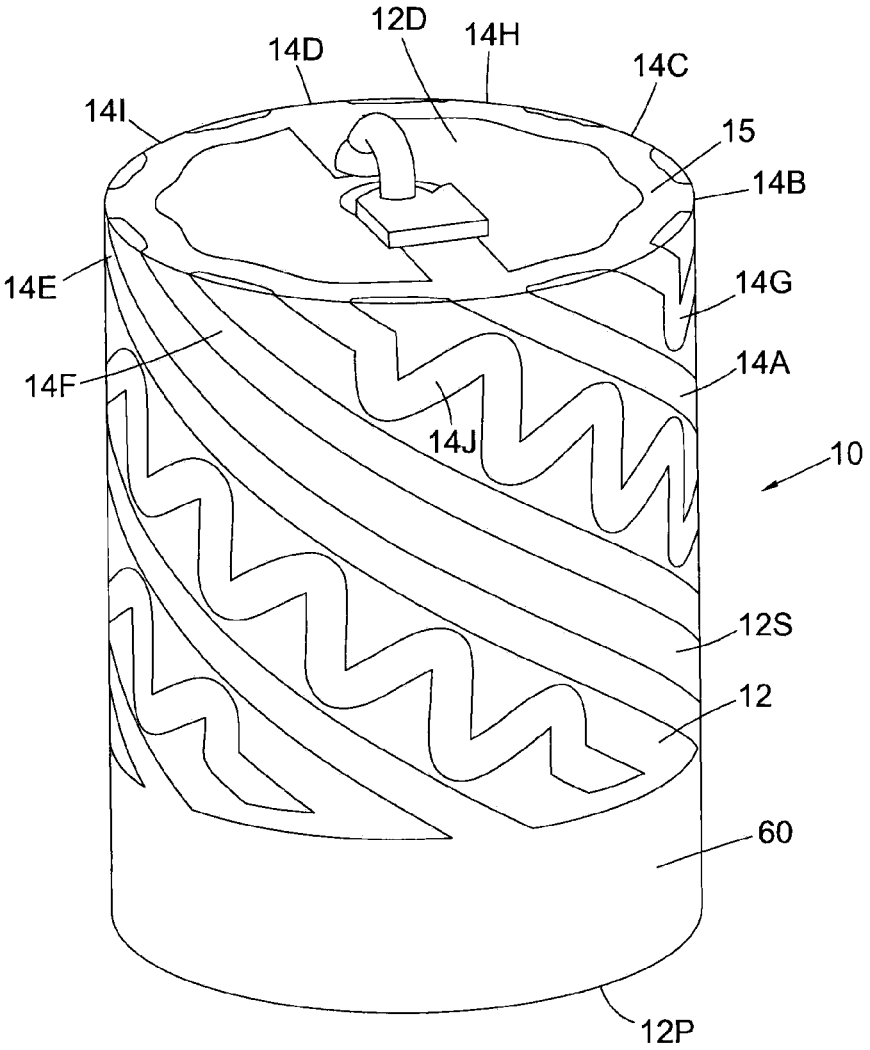
FIG. 1 is a perspective view of an antenna according to a first embodiment of the disclosed technology, viewed from one side and from a distal end.

Referring to FIG. 1, an antenna in accordance with an embodiment of the disclosed technology comprises a backfire dielectrically-loaded decafilar helical antenna 10 having a cylindrical dielectric core 12, the core being made of a ceramic material typically which, in this instance, has a relative dielectric constant of 36. In this embodiment, which is intended for operation in the GPS L1 and L2 bands (1575.42 MHz and 1227.6 MHz), the core has a diameter of 14 mm. The length of the core, at 17.75 mm, is greater than the diameter, but in other embodiments it may be less.

The core 12 has a proximal core surface portion 12P which extends perpendicularly with respect to the antenna axis and the side surface portion 12S. This forms an end face of the antenna. The other end of the antenna is formed by a distal surface portion 12D of the core which also extends perpendicularly to the antenna axis and forms another end face. Both end faces 12D, 12P are oppositely directed, in that one is directed distally and the other proximally in this embodiment of the disclosed technology.

Figure 2A:
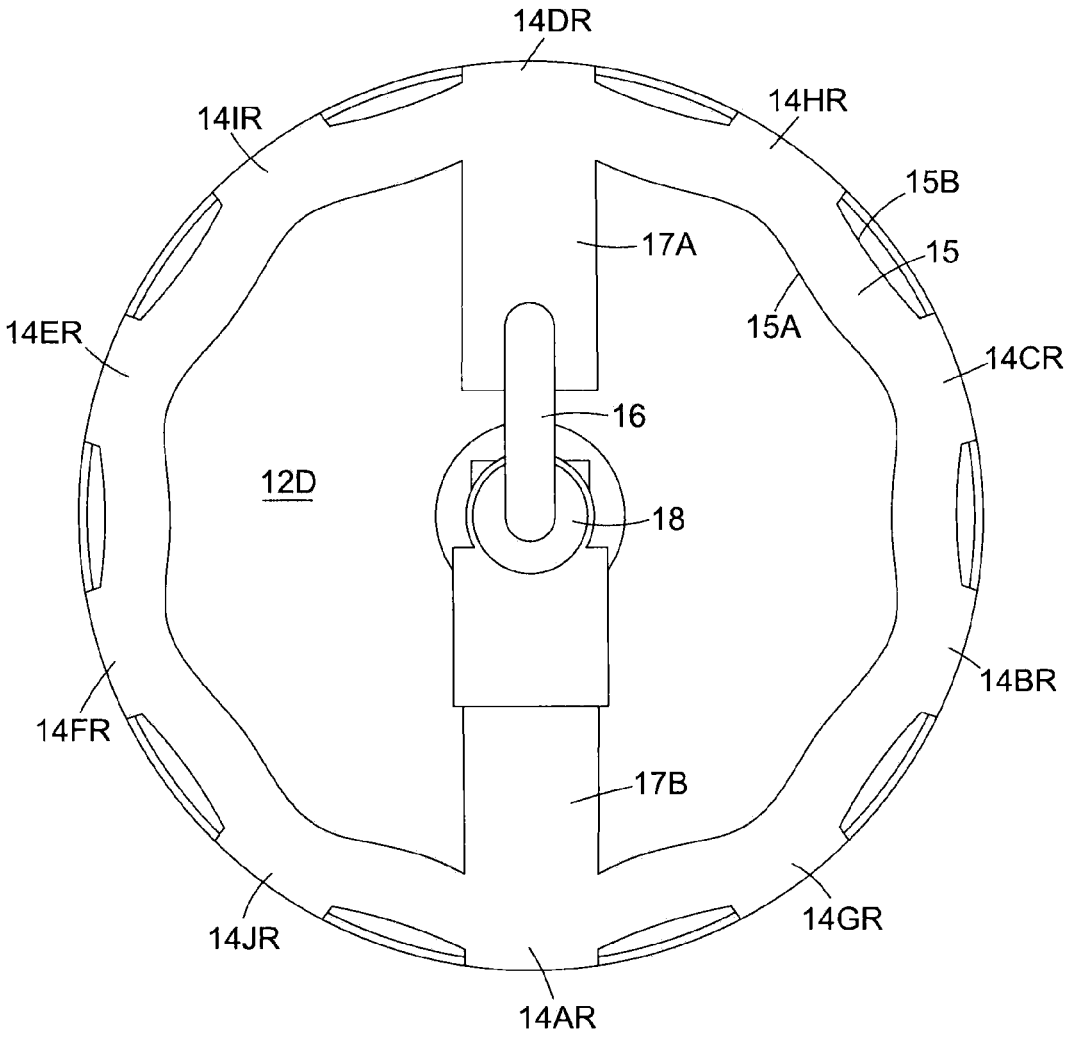
FIG. 2A is a plan view of the antenna of FIG. 1, showing a distal end conductor pattern of the antenna according to the first embodiment of the disclosed technology.

As shown in FIG. 2A, plated on the distal core surface portion 12D is a conductive phasing ring 15 according to a first embodiment of the disclosed technology. The phasing ring is dielectrically loaded by the substrate and the phasing ring is resonant at one or more operating frequencies. For example, the phasing ring may be formed such that it has two resonant modes, i.e. the outer edge of the phasing ring resonates at a first frequency, and the inner edge of the phasing ring resonates at a second frequency higher than the first frequency. In this embodiment of the disclosed technology, the phasing ring 15 has an average diameter of 12 mm.

Alternatively, a narrower conductive track of the phasing ring can be provided such that the difference in the electrical lengths between the outer edge and the inner edge of the phasing ring is insignificant. In such a configuration, the phasing ring may resonate at a centre frequency, with a broader bandwidth.

It will be appreciated that the electrical lengths of the phasing ring are determined by factors including its physical path length and the relative dielectric constant of the core material.

Extending inwardly and radially from the inner periphery of the conductive phasing ring 15 and plated on the distal core surface portion 12D are two feed connection conductors 17A, 17B which are connected to the conductive phasing ring 15 at diametrically opposite positions. The inner end portions of the feed connection conductors 17A, 17B, i.e. their end portions adjacent the central axis of the antenna, form feed nodes which, together constitute a balanced feed connection of the antenna. Each feed connection conductor 17A, 17B forms a series inductance at the operating frequency of the antenna.

Figure 2B:
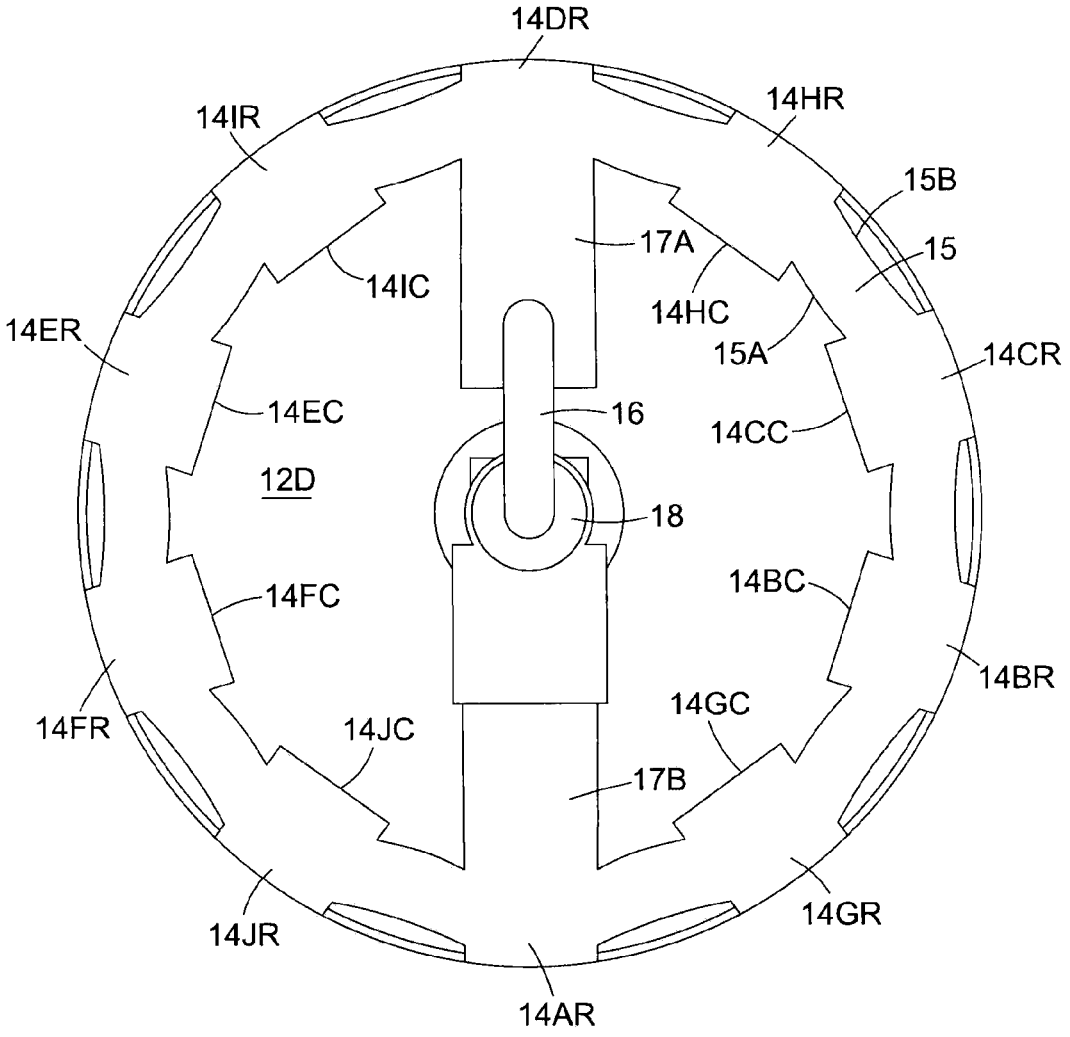
FIG. 2B is a diagram illustrating an alternative distal end conductor pattern for an antenna according to a second embodiment of the disclosed technology.

In an alternative embodiment of the disclosed technology, the conductive phasing ring 15 of the antenna comprises radial sections which extend inwardly from the conductive phasing ring. As shown in FIG. 2B, the conductive phasing ring 15 comprises radial sections 14BC, 14CC, 14EC, 14FC, 14GC, 14HC, 14IC, 14JC which extend inwardly and radially from the inner edge of the conductive phasing ring 15. In this arrangement, the conductive phasing ring 15 acts as a set of relatively high impedance line sections (inductive sections) connecting to wider relatively low impedance line sections (capacitive sections). Effectively, the capacitive sections allow the resonant frequency of the phasing ring to be tuned downwards. It is further noted that the transitions between the high and low impedance sections of the conductive phasing ring 15 also tend to lower the frequency of the ring resonance, being equivalent to T or $\pi$ low pass networks.

In this embodiment of the disclosed technology, the conductive phasing ring 15 is continuous. However, as described hereinafter in another embodiment of the disclosed technology, it is also possible to have, typically, two breaks, bridged with capacitors.

Although, in the described embodiments, there are ten helical radiating elements, a smaller or larger number may be used, e.g. fourteen, twelve, eight, six, or four. A common feature, however, is that the phasing ring 15 forms a closed conductive loop resonant at one or more operating frequencies. In this way, the ring 15 dictates the phasing of the helical elements. Use of a resonant ring in this way, particularly when embodied as a plated conductor or conductor portions on the substrate formed by the core 12, forms an especially stable phasing element which can be produced comparatively inexpensively compared with lumped phasing networks, whilst maintaining a good manufacturing yield. In this example, with three quarter-wave helical elements, the antenna impedance at the feed nodes is relatively low (typically a few ohms). As mentioned above, the feed nodes form a balanced feed point.

Figure 3:
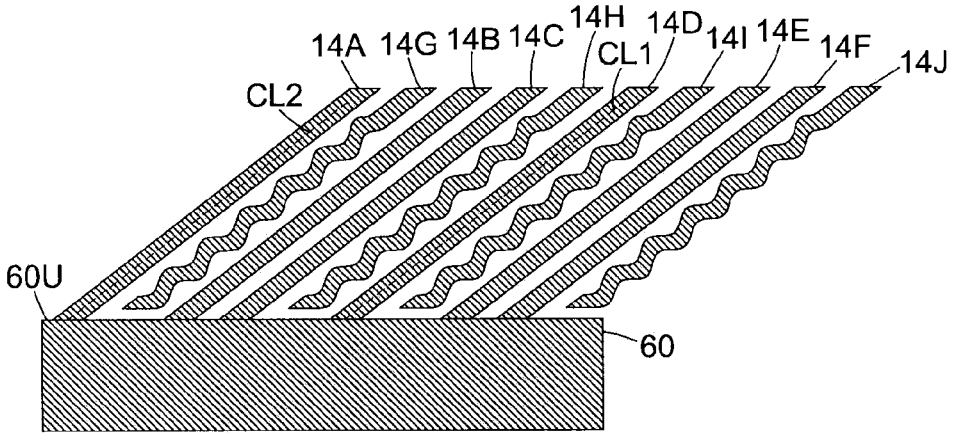
FIG. 3 is a representation of the conductor pattern on an outer cylindrical surface portion of the antenna according to embodiments of the disclosed technology, transformed to a plane.

Plated on a cylindrical outer side surface portion 12S are axially nominally half-turn helical tracks 14A-14J, each track forming an elongate conductive radiating element centred on a central axis (not shown) of the antenna defined by the cylindrical side surface portion 12S of the core 12. As shown in FIGS. 1 and 3, the decafilar helical antenna comprises an antenna element structure with ten elongate conductive radiating elements constituted by two groups of such elements, one group comprising a plurality of closed-circuit helical conductive tracks 14A-14F, and another group comprising a plurality of open-circuit conductive tracks 14G-14J, these tracks all being plated or otherwise metallised on the cylindrical outer surface portion 12S of a solid cylindrical core 12. In this embodiment of the disclosed technology, there are six closed-circuit tracks 14A, 14B, 14C, 14D, 14E, 14F, and four open-circuit tracks 14G, 14H, 14I, 14J.

Referring to FIG. 3 in conjunction with FIG. 1, the closed-circuit helical conductive tracks are constituted by purely helical conductor tracks 14A-14F and the open-circuit conductor tracks 14G-14J are generally helical but follow paths that are meandered about a helical mean and are, therefore, longer than the purely closed-circuit helical tracks. In this embodiment of the disclosed technology, the meandering of the open-circuit elements has a sinusoidal peak-to-peak centreline amplitude is less than or equal to 3 mm.

The proximal ends of the six closed-circuit tracks 14A-14F are connected by a common virtual ground conductor 60. In this embodiment, the common conductor is a second annular phasing ring and is in the form of a plated sleeve surrounding a proximal end portion of the core 12. This sleeve is, in turn, connected to a shield conductor of a feeder, where it emerges proximally from the core, by a plated conductive covering (not shown) of the proximal end face 12P of the core 12.

In this embodiment of the disclosed technology, the closed-circuit helical tracks 14A-14F, representing a first group of radiating elements, are resonant at a second, lower operating frequency; in this case the GPS L2 frequency, 1227.60 MHz. This represents a second mode of resonance of the antenna. The radiating elements are also connected to the distal phasing ring 15 at angularly spaced apart positions by their respective connection portions 14AR-14FR, as will be described hereinafter.

Referring to FIGS. 2A and 2B, the couplings between the antenna elements 14A-14J and the phasing ring 15 are made via conductive connection portions associated with the helical tracks 14A-14J, these connection portions being formed as short radial tracks 14AR, 14BR, 14CR, 14DR, 14ER, 14FR, 14GR, 14HR, 14IR, 14JR, plated on the distal end face 12D of the core 12. Each connection portion extends from a distal end of the respective helical track to the outer edge 15B of the conductive phasing ring 15 plated on the core distal face 12D. As shown in FIGS. 2A and 2B, the phasing ring 15 is nearer the periphery of the distal face 12D of the core 12 and the distal ends of the helical tracks 14A-14J than it is to the central axis of the antenna and the axial transmission line feeder section.

The backfire decafilar helical antenna has a coaxial transmission line housed in an axial bore that passes through the core from the distal end face 12D to the proximal end face 12P of the core.

The core 12 has an axial passage and the passage houses a coaxial feeder structure having an outer conductor, an inner conductor dielectric insulating layer and an inner conductor.

The outer conductor of the feeder structure may be spaced from the wall of the axial passage through the core 12 in which it is housed by a dielectric layer having a relative dielectric constant less that the relative dielectric constant of the material of the core. In particular, such a dielectric layer may consist of plastics sheath as described and shown in the above-mentioned British Patent No. 2367429,the entire contents of which are incorporated in the present application by reference.

Effectively, the combination of the inner conductor of the coaxial transmission line and the insulative layer constitutes a transmission line of predetermined characteristic impedance, here 50 ohms, passing through the antenna core 12 in an axial bore for coupling distal ends of the helical tracks 14A-14J to radio frequency (RF) circuitry of equipment to which the antenna is to be connected.

Referring to FIGS. 2A and 2B, the end portion of one of the feed connection conductors 17A is connected to the inner conductor 16 of the coaxial transmission line at the distal end of the core 12, and the end portion of the other feed connection conductor 17B is connected to the feeder screen formed by the outer conductor 18 of the coaxial transmission line.

Referring to FIG. 3, the six closed-circuit helical tracks 14A-14F of the first group are of different lengths, each set 14A-14C, 14D-14F of three elements having elements of slightly different lengths as a result of the rim 60U of the sleeve being of varying distance from the proximal end face 12P of the core. The three conductive loops running between the opposite sides of the phasing ring 16 formed, respectively, by (a) the shortest closed-circuit helical tracks 14A, 14D and the sleeve rim 60U, (b) the intermediate length closed-circuit helical tracks 14B, 14E and the sleeve rim 60U, and (c) the longest closed-circuit helical tracks 14C, 14F and the sleeve rim 60U each have an effective electrical length approximately equal to $\lambda_{g2}$, which is the guide wavelength along the loops at the frequency of the second resonant mode. These radiating elements are half-turn elements and are formed on the cylindrical surface portion 12S of the core. The configurations of the closed-circuit helical tracks 14A-14F and their interconnection are such that they operate similarly to a simple dielectrically loaded hexafilar helical antenna, the operation of which is described in more detail in the above-mentioned GB2445478A.

In contrast to the closed-circuit helical tracks 14A-14F, the other helical conductor tracks 14G-14J have open-circuit proximal ends on the core cylindrical surface portion 12S at locations between the distal end surface portion 12D of the core and the sleeve rim 60U, as shown in FIGS. 1 and 3. The arrangement of these open-circuit helical tracks is such that they are also distributed around the core, being interleaved between the closed-circuit helical tracks 14A-14F, each open-circuit track 14G-14J executing approximately a half-turn around the axis of the core. Each open-circuit track 14G-14J forms, in combination with its respective radial connection element 14GR-14JR on the core distal end surface portion 12D, a three-quarter-wave monopole in the sense that, in this embodiment, the electrical length of each track is approximately equal to three quarters of the guide wavelength $\lambda_{g1}$ along the tracks at the frequency of a first circularly polarised resonant mode of the antenna determined inter alia by the length of the open-circuit elements. In this embodiment, the frequency of the first circularly polarised resonant mode is the GPS L1 frequency, 1575.42 MHz. It is noted that the skilled person in the art would appreciate that the number of turns of the antenna elements can be optimised depending on the application.

As is the case with the closed-circuit helical conductor tracks 14A-14F, the open-circuit tracks 14G-14J also exhibit small differences in physical and electrical length. Thus, the open-circuit tracks include a first pair of diametrically opposed tracks 14G, 14I which are longer than a second pair of diametrically opposed tracks 14H, 14J. These small variations in length phase-advance and phase-retard their respective individual resonances to aid in synthesising a rotating dipole at the frequency of the first circularly polarised resonant mode.

It should be noted that, in this embodiment of the disclosed technology, the frequency of the first resonant mode is higher than that of the second resonant mode. In other embodiments, the opposite may be true. Fundamental or harmonic resonances of the helical elements may be used, although in general, the closed-circuit elements have an average electrical length of $n\lambda_{g2}/2$ and the open-circuit elements have an average electrical length of $(2m-1)\ \lambda_{g1}/4$, where n and m are positive integers.

Since there is no connection of the system of monopole elements formed by the open-circuit helical tracks 14G-14J and their respective radial tracks 14GR-14JR to the sleeve rim 60U, the first circularly polarised resonant mode is determined independently of the ring resonance of the sleeve rim 60U. Nevertheless, the distal phasing ring 15 and the balun formed by the sleeve 60, the coaxial transmission line and their interconnection by the plated layer of the proximal end surface portion 12P of the core improve the consistency of matching of the quadrifilar monopoles 14G-14J, thereby producing a stable circularly polarised radiation pattern in the first resonant mode. This is advantageous in that it allows the antennas to be mass produced with consistent matching. In addition, the tolerances on the monopole lengths are less critical as a result.

In respect of the two sets of five helical tracks 14C, 14H, 14D, 14I, 14E; 14F, 14J, 14A, 14G, 14B connected to the distal phasing ring 15, the sequence of closed-circuit tracks 14A, 14B, 14C; 14D, 14E, 14F and open-circuit tracks 14G, 14H; 14I, 14J respectively around the core is such that it is symmetrical about centre lines CL1; CL2 (see FIG. 3). In other words, for each feed coupling node, the sequence is mirrored about the respective centre line. More particularly, the arrangement of the helical tracks is such that, in respect of the helical track elements connected to each feed coupling node, they comprise pairs of neighbouring antenna elements, each pair comprising one closed-circuit antenna element and one open-circuit antenna element, and the sequence of antenna elements is such that, in a given direction around the core, the number of pairs in which a closed-circuit element precedes an open-circuit element is equal to the number of pairs in which, in the same direction the open circuit element precedes the closed circuit element. Bearing in mind that, in the present context, each such "pair" of elements can include at least one element which is also an element of another such pair, the antenna elements coupled to one side of the distal phasing ring 15 comprises four pairs 14C, 14H; 14H, 14D; 14D, 14I; and 14I, 14E. Of these four pairs, viewing the sequence from above the antenna (i.e. from a position located distally of the distal core surface portion 12D) in an anticlockwise direction there are two pairs 14C, 14H; 14D, 14I in which the closed-circuit element precedes the open circuit element and two pairs 14H, 14D; 14I, 14E in which the open-circuit element precedes the closed-circuit element, thereby satisfying the condition of equal numbers of pairs, as specified above. The same is true of the antenna elements connected to the other side of the phasing ring 15. Thus, there are two pairs 14F, 14J; 14A, 14G in which the closed-circuit element precedes the open-circuit element and two pairs 14J, 14A, 14G, 14B in which the open-circuit element precedes the closed-circuit element. This sequencing of closed-circuit and open-circuit elements has been found to produce a superior radiation pattern in comparison to an antenna which does not meet this condition.

It is possible to meet the condition with an antenna having four closed-circuit elements and four open-circuit elements only. However, the combination of six elements of one kind and four of the other kind, i.e. in this case, six closed-circuit elements and four open-circuit elements, is preferred because a more uniform spacing of the elements of each group 14A-14F; 14G-14J can be obtained. Accordingly, given that the complete set of antenna elements 14A-14F; 14G-14J is distributed around the core, in any given plane perpendicular to the antenna axis, the closed-circuit helical tracks 14A-14F have angular spacings of 72° (in respect of four pairs of tracks) and 36° (in respect of two pairs of tracks). The maximum deviation from the optimum spacing of 60° is 24°. With regard to the four open-circuit helical tracks 14G-14J, the inter-element angular spacings are 72° and 108°, i.e. yielding a deviation of only 18° from the 90° optimum.

The antenna has resonant frequencies determined by the effective electrical lengths of the helical antenna elements 14A-14F; 14G-14J, as described above. The electrical lengths of the elements, for a given frequency of resonance, are also dependent on the relative dielectric constant of the core material, the dimensions of the antenna being substantially reduced with respect to an air-cored quadrifilar antenna. Since the phasing rings are plated on the core material, their dimensions are also substantially reduced with respect to full wavelength rings in air.

Precise dimensions of the antenna elements 14A-14F and 14G-14J can be determined in the design stage on a trial and error basis by undertaking empirical optimisation until the required phase differences are obtained. The diameter of the coaxial transmission line in the axial bore of the core is in the region of 2 mm.

The radiation pattern of the antenna is similar to that exhibited by conventional dielectrically-loaded quadrifilar antennas in that it is cardioid-shaped, having a distally directed axial maximum and being substantially omnidirectional in azimuth.

It will be appreciated that an antenna in accordance with the disclosed technology can be adapted for left-hand circularly polarised waves. One service using left-hand circularly polarised waves is the GlobalStar voice and data communication satellite system which has a band for transmissions from handsets to satellites centred on about 1616 MHz and another band for transmissions from satellites to handsets centred on about 2492 MHz.

It will be appreciated that the design parameters of the antenna can be optimised for particular use in a number of bands of operation, for example, namely:

(a) 1559-1591 MHz (Galileo satellite positioning system)
(b) 1260-1300 MHz (Galileo satellite positioning system)
(c) 1164-1214 MHz (Galileo satellite positioning system)
(d) 1563-1587 MHz (GPS L1)
(e) 1216-1240 MHz (GPS L2)
(f) 1164-1188 MHz (GPS L5)
(g) 1602.56-1615.50 MHz (Glonass)
(h) 1240-1260 MHz (Glonass)
(i) 1610.0-1626.5 MHz (Iridium satellite communication)
(j) 2332.5-2345.0 MHz (XM-Sirius satellite radio under XM band)
(k) 2320.0-2332.5 MHz (XM-Sirius satellite radio under Sirius band)

The services associated with these bands are indicated above in brackets.

Figure 4:
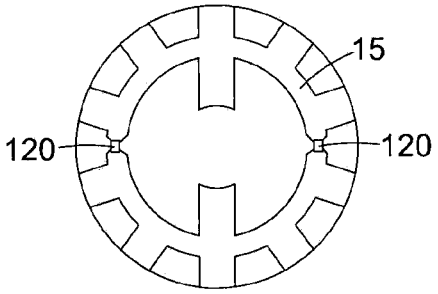
FIG. 4 is a diagram showing a modified distal end conductor pattern for an antenna according to a third embodiment of the disclosed technology.

Referred to above is the possibility of the phasing ring 15 being non-continuous, with breaks bridged by capacitors. Such a variant offers greater flexibility in choosing the resonant frequency of the phasing ring within a given space. One such variant is illustrated in FIG. 4, which is a plan view of an end face of a cylindrical core 12 having plated thereon a phasing ring 16 with two breaks bridged by respective capacitors 120. In this variant, the phasing ring is connected at its outer periphery to 10 helical radiating elements using short radial connecting portions as described above with reference to FIGS. 2A and 2B.

The invention claimed is:

1. A dielectrically loaded multifilar antenna for circularly polarised radiation the antenna having a plurality of operating frequencies in excess of 200 MHz, wherein the antenna comprises:

an electrically insulative core having proximal and distal surface portions and, between the proximal and distal surface portions, a laterally directed side surface portion; a pair of feed nodes; at least four elongate generally helical conductive radiating elements located on the core; and, arranged between and coupling together the feed nodes and the radiating elements, a phasing ring formed by a closed loop which is resonant at least one of the operating frequencies, the radiating elements being coupled to the phasing ring at respective spaced apart coupling locations; the antenna further comprising a conductive linking element extending around the core side surface portion, wherein the radiating elements comprise a first group of elements extending from the phasing ring over the core side surface portion to closed-circuit terminations on the linking element and a second group of elements extending from the phasing ring to open-circuit terminations on the said side surface portion which are spaced from the linking element, and wherein each of the elements of one of said groups is meandered about a respective pure helix.

2. An antenna according to claim 1, wherein the radiating elements comprise conductive tracks metallised on the core side surface portion, the tracks of the said one group of elements having a centreline which deviates from a respective pure helix to form a generally sinusoidal path.

3. An antenna according to claim 2, wherein the sinusoidal path has a peak-to-peak amplitude of less than or equal to 3 mm.

4. An antenna according to claim 1, wherein the said one group is the second group of radiating elements.

5. An antenna according to claim 4, wherein the electrical length of each of the radiating elements in the second group is different from the electrical length of each of the radiating elements in the first group.

6. An antenna according to claim 5, wherein the electrical length of each of the radiating elements in the first group is a half wavelength or an integer multiple thereof at a first of the operating frequencies.

7. An antenna according to claim 5, wherein the electrical length of each of the radiating elements in the second group is a $(2n-1)/4$ times the wavelength at a second of the operating frequencies, where n is a positive integer.

8. An antenna according to claim 1 having at least ten helical antenna elements.

9. An antenna according to claim 1, wherein the phasing ring is resonant at least one of the operating frequencies.

10. An antenna according to claim 1, wherein the antenna has a central axis and the phasing ring comprises a conductive track encircling the central axis of the antenna.

11. An antenna according to claim 10, wherein said conductive track has an inner edge and an outer edge, and the phasing ring further comprises one or more inwardly extending radial sections extending from the inner edge of said conductive track.

12. An antenna according to claim 10, wherein the conductive track of the phasing ring is formed such that the phasing ring resonates at one or more frequencies.

13. An antenna according to claim 10, wherein the conductive track of the phasing ring is meandered.

14. An antenna according to claim 13, wherein the meandering of the phasing ring has a sinusoidal peak-to-peak centreline amplitude that is less than or equal to 2 mm.

15. An antenna according to claim 1, wherein the phasing ring is circular.

16. An antenna according to claim 1, wherein the phasing ring comprises a continuous annular conductor.

17. An antenna according to claim 1, wherein the phasing ring includes at least a pair of lumped reactances in series with conductive track portions, which portions, together with the reactances, form the said closed loop which is resonant at said one or more operating frequencies.

18. An antenna according to claim 1 constructed as an end-fire antenna.

19. An antenna according to claim 1, wherein the conductor track is located on the distal surface portion.

20. An antenna according to claim 19, constructed as a backfire antenna.

21. A dielectrically loaded multifilar antenna for circularly polarised radiation having a plurality of operating frequencies in excess of 200 MHz, wherein the antenna comprises: an electrically insulative core having proximal and distal surface portions and, between the proximal and distal surface portions, a laterally directed side surface portion; a pair of feed nodes; at least four elongate generally helical conductive radiating elements located on the core; and, arranged between and coupling together the feed nodes and the radiating elements, a phasing ring formed by a closed loop, wherein the phasing ring is resonant at least two of the operating frequencies, the elongate antenna elements being coupled to the phasing ring at respective spaced apart coupling locations and extending from the phasing ring in a direction away from the feed nodes, wherein the phasing ring comprises a conductive track and the phasing ring is formed such that an outer edge of the conductive track resonates at a first frequency of said plurality of operating frequencies, and an inner edge of the conductive track resonates at a second frequency of said plurality of operating frequencies.

22. An antenna according to claim 21, wherein the phasing ring comprises a continuous annular conductor.

23. An antenna according to claim 21, wherein the antenna has a central axis, and the conductive track encircles the axis.

24. An antenna according to claim 23, wherein the phasing ring further comprises one or more inwardly extending radial sections extending from the inner edge of said conductive track.

25. An antenna according to claim 21, wherein the conductive track of the phasing ring is meandered.

26. An antenna according to claim 25, wherein the meandering of the phasing ring has a sinusoidal peak-to-peak centreline amplitude less than or equal to 2 mm.

27. An antenna according to claim 21, wherein the feed nodes and the phasing ring are located on the distal surface portion, and the said elongate conductive radiating elements extend over the side surface portion from the phasing ring towards the proximal surface portion.

28. An antenna according to claim 21, further comprising a conductive linking element extending around the core side surface portion, wherein the radiating elements comprise a first group of elements extending from the phasing ring over the core side surface portion to closed-circuit terminations on the linking element and a second group of elements extending from the phasing ring to open-circuit terminations on the said side surface portion which are spaced from the linking element, and wherein each of the elements of one of said groups is meandered about a respective pure helix.

29. An antenna according to claim 28, wherein the radiating elements comprise conductive tracks metallised on the core side surface portion, the tracks of the said one group of elements having a centreline which deviates from a respective pure helix to form a generally sinusoidal path of which the peak-to-peak amplitude is less than or equal to 3 mm.

* * * * *